United States Patent [19]

Judd

[11] 4,105,089

[45] Aug. 8, 1978

[54] FLOW DISTRIBUTOR FOR GAS TURBINE SILENCERS

[76] Inventor: Frederick V. H. Judd, 4876 Victor St., Jacksonville, Fla. 32207

[21] Appl. No.: 634,848

[22] Filed: Nov. 24, 1975

[51] Int. Cl.[2] ..... F01N 1/08; F01N 1/10

[52] U.S. Cl. ..... 181/264; 181/256; 181/268; 181/274; 181/275

[58] Field of Search ..... 181/49, 50, 54, 55, 181/56, 61, 63, 33 HE, 35 R, 264, 256, 268, 274, 275, 224

[56] References Cited

U.S. PATENT DOCUMENTS

| | | | |
|---|---|---|---|
| 2,940,537 | 6/1960 | Smith et al. | 181/50 |
| 2,959,243 | 11/1960 | Smith | 181/56 |
| 3,185,252 | 5/1965 | Lemmerman | 181/56 |
| 3,454,129 | 7/1969 | Everett | 181/56 |
| 3,702,744 | 11/1972 | Fowler, Jr. et al. | 181/50 |
| 3,894,610 | 7/1975 | Halter et al. | 181/50 |

*Primary Examiner*—Stephen J. Tomsky

[57] ABSTRACT

Gas turbine exhaust quieting means wherein the low frequency noise which is normally generated by turbulence in the gas turbine exhaust, is suppressed by means of a turbulence suppressing flow distributor. Said flow distributor comprising an elongated, hollow body, having a multiplicity of small holes in the walls thereof. Said flow distributor also providing a means for uniformly distributing the gas turbine exhaust flow over the face of a tubular or splitter type of exhaust gas silencer, which is usually used in combination with the flow distributor.

11 Claims, 8 Drawing Figures

FIG. 6
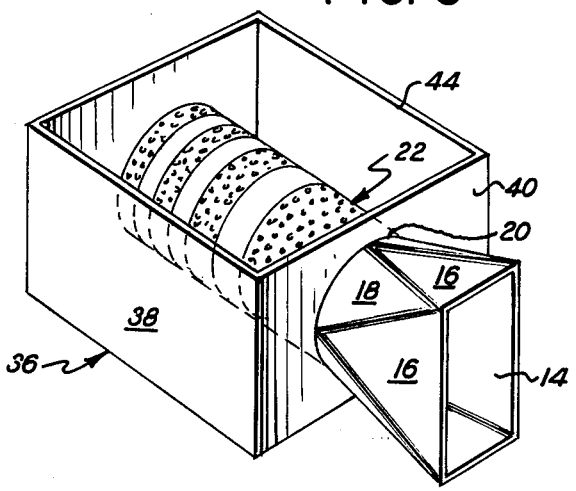
FIG. 5
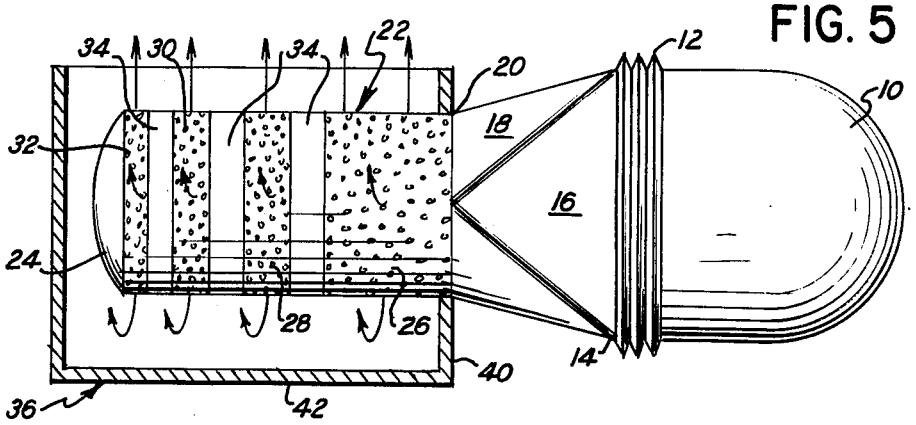
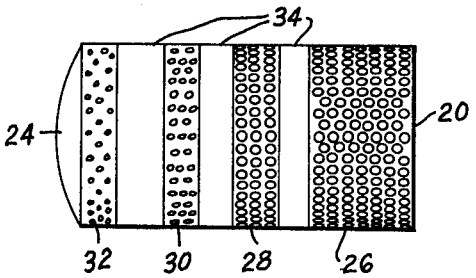
FIG. 7
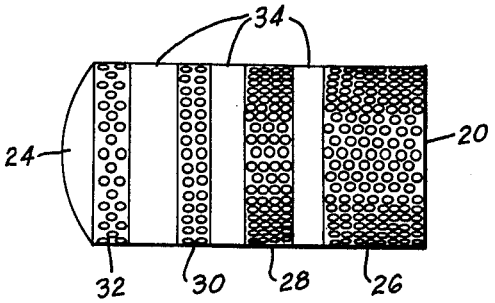
FIG. 8

FLOW DISTRIBUTOR FOR GAS TURBINE SILENCERS

This invention relates to a method and means for suppressing the exhaust noise of combustion gas turbines. The very low frequency portion of the noise, which is generated by turbulence in the exhaust gas after the rotating portion of the turbine, is suppressed by means of a special design of flow distributor, designed to reduce this turbulence. The flow distributor also can be positioned to distribute the exhaust gas uniformly over the face of the tubular or splitter type of silencer which is desirably used in conjunction with the flow distributor to suppress the higher frequency noise in the exhaust stream.

According to the present invention, a flow distributor is mounted to receive the noisy exhaust of a combustion gas turbine.

Such flow distributor consists of a housing of rigid walls, usually metal, of sufficient gauge to resist much of the accompanying vibrations of the gas stream, and sized to accomodate the volume flow of the gas stream without developing a back pressure upon the turbine so as to have little or no effect upon its operating efficiency. The walls of the flow distributor are perforated to pass and thereby diffuse the gas stream laterally outward against a deflecting shield or into a surrounding plenum chamber. The perforations in the wall of the flow distributor are found to have an improved gas distribution effect when they are distributed in groups, spaced axially from each other, such as in separated bands of perforations distributed circumferentially around the walls of the flow distributor. That arrangement appears to allow relatively even radial flow of the exhaust gas outward through the perforations in the flow distributor housing wall.

The effect, without intending to be limited to theory, is to reduce the turbulence in the gas turbine discharge, thereby removing or reducing the low frequency noises in this area, such as in the range of 30 - 60 hertz by designing to accomodate the gas flow in the volume produced, without developing significant back pressure upon the turbine per se. As a consequence, the low frequency noise attending this type of turbulence, is damped to a point where it is substantially reduced, almost completely removed.

Since the combustion gas turbine exhaust gas is at a high temperature, it is practical to provide a flow distributor to divert the gas leaving the gas turbine in a desired disposal direction.

In a further aspect of this invention, the flow distributor is usefully combined with an exhaust gas silencer, either of the tubular or splitter type as known in the art, and for this purpose the said shield is shaped to pass and distribute the exhaust gas evenly over the inlet of the several tubes comprising a tubular type silencer or over the several inlets of a slitter type silencer. That combination thereby damps and removes the low and high frequency sound emissions accompanying exhaust gas from combustion gas turbines.

The exhaust gas silencer, tubular or splitter type, when operated alone to reduce audible sounds in the exhaust gas is generally of lower efficiency in that the exhaust gas distributed to the banks of tubes or perforated splitters is passed therethrough generally unevenly, most passing irregularly through some tubes or splitter passages and little through others, thus providing overall poor noisy sound reaction because of the poor distribution. That uneven distribution of the high temperature and highly turbulent gas also is more corrosive and erosive to the silencer structure. The combination of these silencers with the flow distributor hereof provides an even distribution of the exhaust gas over the entire inlet area of the silencer, tubular or splitter types, whereby to both reduce noisy sound vibrations more efficiently because of the even distribution of the gas stream emitted from the flow distributor therethrough, and by the distributor structure, remove the lower frequency noise before it reaches the silencer.

The invention is further described and illustrated by the drawings herewith wherein:

FIG. 5 shows the flow distributor alone combined with an acoustic shield; and FIG. 6 is a similar view, in perspective as shown in FIG. 5, with the duct coupling shown and from which the turbine is omitted.

FIG. 7 shows a detail of a flow distributor having large perforations near the open end decreasing in size toward the closed end; and FIG. 8 shows a similar detail of the flow distributor having more perforations near the open end, decreasing in number, while increasing in spacing toward the closed end.

Figure 1:
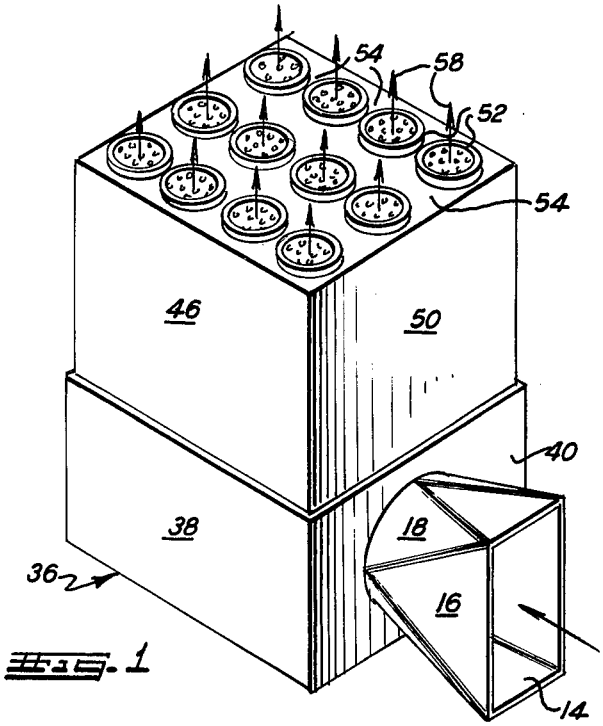
FIG. 1 is a perspective view of the combined units, flow distributor, and silencer of the tubular type.

Referring first to FIGS. 5 and 6, the combustion gas turbine is not shown, but it is a typical combustion gas turbine, only its end being shown, has its exhaust duct 10 coupled by an expansion joint 12 to a rectangular diffuse inlet duct 14, which through several geodesic adapter plates 16 and 18, converts the combustion gas exhaust stream into an annular cylindrical stream passing to the annular inlet 20 of a cylindrical flow distributor housing 22. That housing open at the inlet 20 is closed by a dished head, conical or reversed conical closure 24 at its outer end, all of the gas passed therein being diverted to pass laterally through groups of annularly disposed bands of perforations 26, 28, 30, and 32. In this manner all of the exhaust gases from the turbine enter the flow distributor 22 and pass radially outward of the cylindrical flow distributor through the bands of perforations. The perforations are disposed as bands in annular group 26, 28, 30, and 32, separated by imperforate rings or blank spaces 34, whereby each group of perforations forms an annular ring through which a gas passes radially. With this construction the flow of the exhaust gas is smoother and is distributed laterally along the length of the flow distributor more evenly from end to end. This spacing of the perforations into bands or annular groups tends to evolve the gases at an even less turbulent velocity from end to end each evenly because of the spacing. The spacing rings 34 which have no perforations are not critically sized but are usually from 10 to 30 inches in length more or less, the size being only sufficient to interrupt the continuity of the perforations along the cylindrical walls of the flow distributor whereby the emission is from groups of perforations and not in a progressive stream from evenly distributed perforations.

The exhaust gas tends to be evolved evenly radially in all directions over the entire circumference of the flow distributor, except that it is somewhat more even in a flow distributor with a cylindrical shape than one in which the housing walls of the flow distributor are arranged as a rectangular or polyhedral structure. Again while the cylindrical form is preferred it can be shaped ellipsoidal or other annular shape. The exhaust gases are preferably deflected by a deflecting or encasing shield 36 so that the hot gas can be diverted in any desired direction for disposal, protective of other neighboring equipment.

It is preferred, however, to construct the shield 36 as a plenum with closed sides 38, ends 40, and bottom 42 so that the exhaust gases will be directed through the open top 44 to pass upward, or other convenient disposal direction. In the construction shown with the open top, however, it is preferred to pass the gases into a silencer such as of the tubular type 46 as shown in FIGS. 1 and 3, or splitter type 48 as shown in FIGS. 2 and 4, the silencer being mounted to cover the open top 44 and receive the gas flow therefrom as an even inlet flow for purposes of reducing the noise therein.

Figure 3:
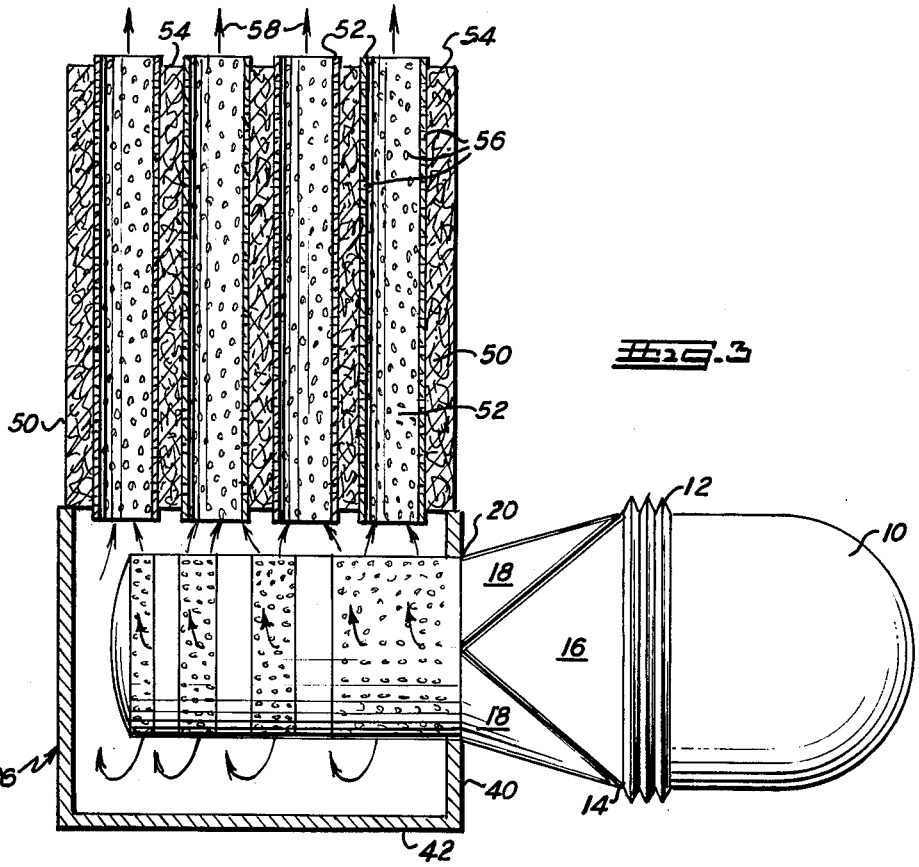
FIG. 3 is a side elevation in section taken through the center of the combined tubular type with the flow distributor and with parts broken away and in section to show internal construction.

As shown in FIGS. 1 and 3, the tubular type comprises a housing 50 in which numerous tubes are vertically supported evenly spaced and separated from each other. Many tubes 52, which are metal tubes or other strong structural materials capable of withstanding the high exhaust temperatures, so mounted and separated by a fibrous or foamlike filler 54. These filler separator substances are porous fiber or foamy filler or any heat resistant character such as asbestos fiber, glass fiber, rock fiber, or other foamy inorganic material such as magnesite through which the noise can pass laterally from the tubes. The tube walls are perforated by perforations 56 which serve as a noise transparent material to allow the noise to pass laterally into the foam or fibrous absorptive substance. The gases pass outward in the direction of the arrows 58. The perforations, however, allow the noise to pass laterally into the porous absorptive packing where it is absorbed and converted into heat. The combination, however, according to the present invention of this silencer structure with the flow distributor, serves to remove both low frequency noise from gas passing through the flow distributor as well as to distribute the gas evenly through the tubes for removal of the audible sound. The ultimate effect is that hot exhaust gases are emitted as shown by the arrows 58 in a steady evenly distributed non-turbulent and quiet stream.

Figure 2:
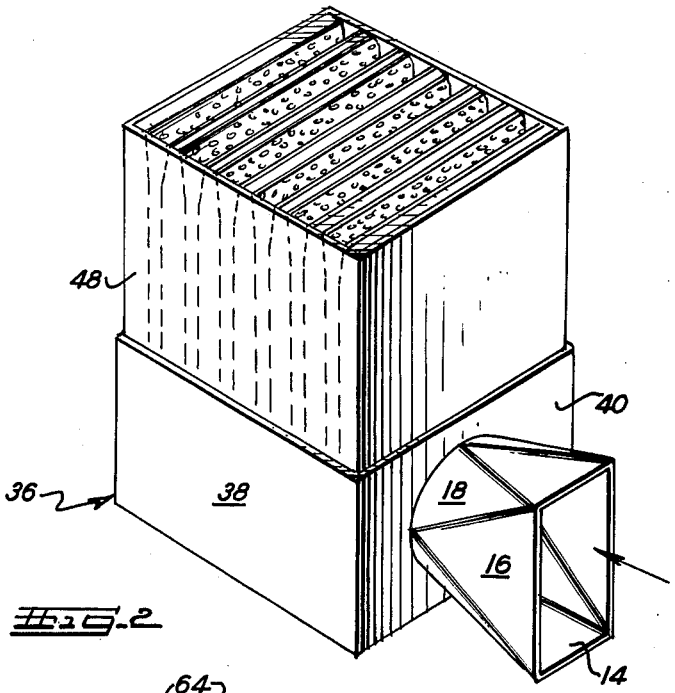
FIG. 2 is the same combination as FIG. 1 having, as shown in dotted lines, the splitter type of silencer.
Figure 4:
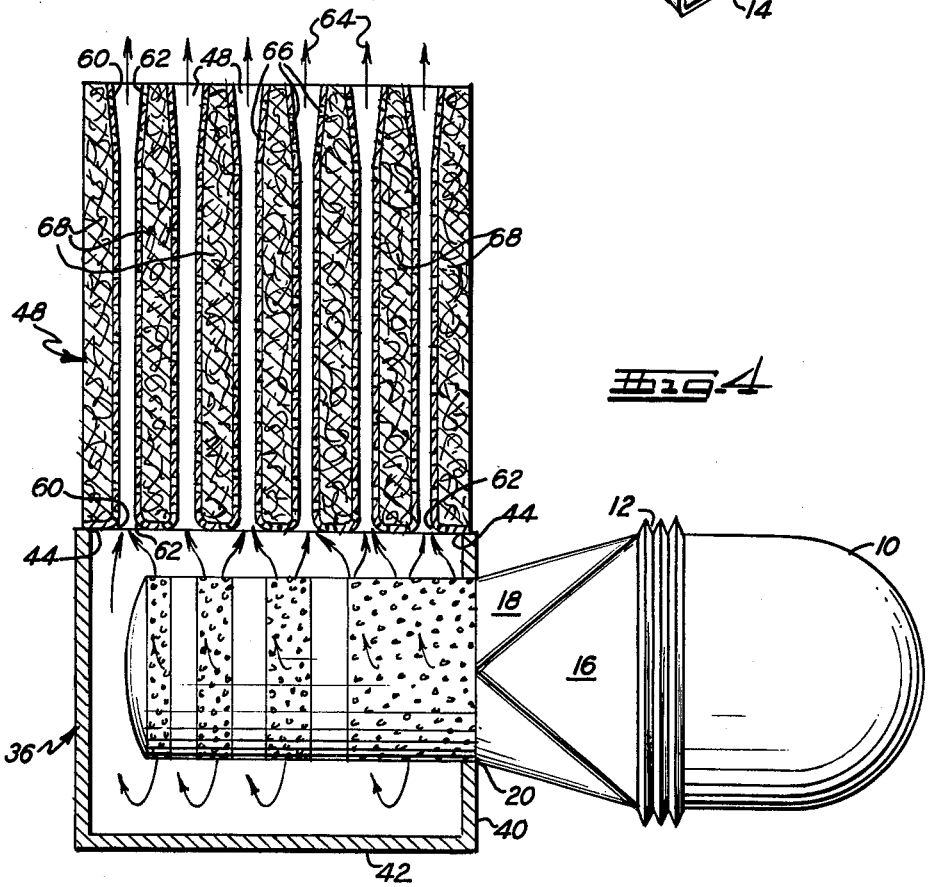
FIG. 4 is a similar section, as shown in FIG. 3, Substituting the splitter type of silencer.

As shown in FIGS. 2 and 4, a splitter type of silencer 48, also of known construction, is shown whose structure consists of metallic walls disposed in facing pairs 60 and 62 providing an open passageway therebetween for receiving and flowing the gas from the lower inlet placed above the top of the flow distributor, passing the same upward through pairs of walls 60 and 62, and thence outward of the structure as shown by the arrows 64. Similarly the walls 60 and 62 are packed on each inner side by porous material 68, foamy or fibrous as stated above, to allow noise passage therethrough and to be absorbed, the walls 60 and 62 similarily being perforated over their surfaces with numerous perforations 66, which allows lateral communication between each wall 60 or 62 with the internal absorptive material 68 with which each pair of walls is packed. The noise thus passes from the passageway between wall 60 and 62 into the absorptive packing, where it is absorbed and converted to heat. The net effect of the structure is to allow the gas to pass through the passageway formed between walls 60 and 62 and thence outward as shown by the arrows 64 while most of the noise will laterally pass through the perforations 66 into the packing 68 for purposes of absorbing the sound in the exhaust gas.

While as stated, both tubular and splitter type silencers are known the combination hereof of either type with a flow distributor serves both to remove low frequency noises, in the range below 60 hertz; and to distribute the high temperature exhaust in an even flow to the inlet of several tubes 52 using the tubular silencer construction, or between the walls of the splitter passageways 60 and 62 using the splitter type silencer. In this manner the overall combination of elements is superior construction in exhaust handling for a combustion gas turbine. However, the flow distributor and shield as shown in FIGS. 5 and 6 can be used alone without the silencer in certain cases.

In operation, the exhaust gas energy, largely in the form of a high velocity stream, is converted to a static pressure thrusting of gas laterally outward through the perforations in the flow distributor wall. The gas in a stream under its usual axial momentum would tend merely to pass out of the end 24 of the flow distributor, if it were open. Since it is closed in normal construction by a cap 24, it would tend to pass laterally or radially outward through the perforations more closely neighboring the end. It is found, however, that this tendency of the gas to pass through perforations near the end is overcome by distributing the perforations in annular bands or groups disposed axially separated from each other by intermediate bands of metal, around the usually cylindrical wall of the flow distributor as shown in FIGS. 5 and 6. While it is economically convenient to separate the bands as evenly spaced groups, it is possible, and sometimes preferable, to use larger spacing near the flow distributor end 24. Moreover, it is sometimes useful to distribute the perforations in even spacing between perforations, but varying the size from end to end with the largest near the open end and smallest near the closed end. Similarly, perforations all of the same size can be used, but ranging the spacing in a progressively even pattern with the largest spacing near the closed end, progressively decreasing towards the open end as shown in the details of FIGS. 7 and 8. Such variation in size and spacing can be combined with the same even variation of both size and spacing from closed end to open.

The effect is to diffuse the gas stream laterally and relatively evenly through the numerous perforations mounted about the walls of the flow distributor in separate bands. Moreover, though these perforations will be distributed in size and number about the walls of the flow distributor chamber to allow free unrestricted passage of the gas laterally in the volume received as exhausted by the turbine, as stated above, the turbulence and low frequency noise are damped, converting the emitted stream into an even-flowing gaseous body without increasing the static pressure or back pressure upon the gas stream as evolved by the turbine. Consequently, there will be no interference with the efficient gas flow from the turbine.

The direct consequence of using this flow distributor is the damping of low frequency vibrations and hence, noise in the exhaust of the gas turbine. Finally, the even flow of gas will then advantageously be passed to a noise silencer of the tubular or the splitter type.

The description herein is intended to be exemplary and not limiting. Certain modifications will occur to those skilled in the art and may be incorporated into the structure described herein. Consequently, the description will be read in the scope of the claims attached,

I claim:

1. A gas flow distributor for exhaust gas emitted from a gas turbine comprising an elongated chamber, closed by walls on all sides and one end, having an open inlet for connecting to a gas turbine exhaust, said chamber being sized to accommodate a turbulently noisy flowing stream of combustion gas exhausted from said turbine, means for solidly coupling the open end of said flow distributor chamber to the exhaust emitted from said turbine, perforations passing through and disposed in bands about the walls of said flow distributor in number, size and spacing graduated from lower to greater gas flow restriction from said open end inlet to the lateral perforations outlets to emit the gas stream passing through said flow distributor in substantially even radial non-turbulent flow therefrom, and shielding means deflecting the exhausted gas stream emitted by said flow distributor in radial direction.

2. The gas flow distributor as defined in claim 1, wherein said flow distributor is an elongated annular body having said graduated perforations disposed about the annular walls progressively varying in size larger to smaller from said open inlet to said closed inlet for evenflowing radial distribution of the exhaust gas stream passing therethrough.

3. The gas flow distributor as defined in claim 1, wherein the perforations in said walls are disposed circumferentially around said chamber in spaced bands of perforations, each perforated band being separated from the next by an inperforate band of metal, said inperforate bands varying progressive in size, shorter to longer from said open end inlet end to said closed end along the axis of flow of the stream passing through said chamber.

4. The gas flow distributor as defined in claim 1, wherein said elongated chamber is cylindrical and the perforations are disposed about the annular walls for radial distribution of the exhaust gas stream passing therethrough, said perforations being disposed circumferentially about the said cylindrical chamber in graduated variations in spacing between perforations, larger spacing to smaller, progressively from said closed end to said open inlet end, along the axis of flow of the gas stream passing through said chamber.

5. The gas flow distributor as defined in claim 1, wherein said shielding means is a housing substantially enclosing said diffuser, said housing being open at one end and has directly mounted thereon a silencer for audible sound intercepting and silencing the sound of the gas stream from said flow distributor.

6. The gas flow distributor as defined in claim 5, wherein said silencer is a tubular type of silencer and said flow distributor and shielding means passes said gas stream in uniform even flow to the inlet of said silencer.

7. The gas flow distributor as defined in claim 5, wherein the silencer is a splitter type silencer and said flow distributor and shielding means passes said gas stream in uniform even flow to the inlet of said silencer.

8. The gas flow distributor as defined in claim 1, wherein the perforations disposed in bands in said walls are varied in size progressively with largest disposed near the open end and the smallest near the closed end converting the emitted gas stream to even nonturbulent flow and the shielding means collects and guides said gas stream to an outlet.

9. The gas flow distributor as defined in claim 1, wherein the spacing between perforations in said walls are progressively varied in size one from the next with the greatest spacing between perforations near the closed end, progressively decreasing in size to the smallest spacing between perforations, near the open end converting the emitted gas stream to even nonturbulent flow and the shielding means collects and guides said gas stream to an outlet.

10. The combination of a gas flow distributor and a sound silencer for muffling the vibrations and sounds of a noisy turbulent exhaust gas stream emitted by a combustion gas turbine, said flow distributor comprising an elongated body mounted in a shield deflecting the emitted gas in a radial direction, said elongated body having perforations in the walls thereof for emitting the exhaust gas radial to the exhaust gas stream passing therein and having one end open and an opposite end closed, means for solidly connecting said open end to an exhaust gas duct conveying said gases from the turbine, said perforations passing through and disposed in bands about the walls of said flow distributor graduated in number, size and spacing to emit the gas stream pasing through said gas distributor in even uniform radial flow therefrom said silencer comprising a series of parallel mounted perforated tubes separated by an acoustically absorbing gas permeable filler between said tubes, said silencer being mounted to receive the gas flowing from said flow distributor in substantial alignment with said shield.

11. The combination of a gas flow distributor and a sound silencer for muffling the vibrations and sounds of a noisy turbulent gas stream emitted by a combustion gas turbine, said flow distributor comprising an elongated body mounted in a shield, said elongated body having perforations in the walls thereof for emitting the exhaust gas radial to the exhaust gas stream passing therein and having one end open and an opposite end closed, means for solidly connecting said open end to an exhaust gas duct conveying said gases from the turbine, said perforations passing through and disposed in bands about the walls of said flow distributor graduated in number, size and spacing to emit the gas stream passing through such gas distributor in even uniform radial flow therefrom said silencer comprising a series of perforated walls defining passageways between pairs of walls having porous acoustically absorbing materials mounted on a surface opposite a wall surface along which the gas is flowed, said silencer being mounted to directly receive the shielded gas stream flowing from said flow distributor in substantial alignment with said shield.

* * * * *